US008624475B2

(12) United States Patent
Shimamura et al.

(10) Patent No.: US 8,624,475 B2
(45) Date of Patent: Jan. 7, 2014

(54) SPARK PLUG

(75) Inventors: Takuya Shimamura, Nagoya (JP); Tomoaki Kato, Nagoya (JP); Jiro Kyuno, Kiyosu (JP); Naomichi Miyashita, Kasugai (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 13/518,126

(22) PCT Filed: Aug. 8, 2011

(86) PCT No.: PCT/JP2011/004495

§ 371 (c)(1),
(2), (4) Date: Jun. 21, 2012

(87) PCT Pub. No.: WO2012/039090

PCT Pub. Date: Mar. 29, 2012

(65) Prior Publication Data

US 2012/0267995 A1 Oct. 25, 2012

(30) Foreign Application Priority Data

Sep. 21, 2010 (JP) ..... 2010-210362

(51) Int. Cl.
*H01T 13/00* (2006.01)

(52) U.S. Cl.
USPC ..... 313/144; 313/118; 313/141; 313/142

(58) Field of Classification Search
USPC ..... 313/118, 143, 144, 141, 142
See application file for complete search history.

(56) References Cited

U.S. PATENT DOCUMENTS

| | | | | | |
|---|---|---|---|---|---|
| 2,734,143 | A | * | 2/1956 | Laird | 313/131 A |
| 4,972,812 | A | * | 11/1990 | Strumbos | 123/169 C |
| 5,502,351 | A | * | 3/1996 | Katoh et al. | 313/141 |
| 5,557,158 | A | * | 9/1996 | Kanao et al. | 313/141 |

(Continued)

FOREIGN PATENT DOCUMENTS

| | | | |
|---|---|---|---|
| JP | 61039880 | 3/1986 | H01T 13/16 |
| JP | 2005190762 | 7/2005 | H01T 13/36 |

(Continued)

OTHER PUBLICATIONS

JIS B 8031—1995, Japanese Industrial Standard, "Spark Plugs for Internal Combustion Engines," dated 1995; 16 pages.

(Continued)

*Primary Examiner* — Nimeshkumar Patel
*Assistant Examiner* — Thomas A Hollweg
(74) *Attorney, Agent, or Firm* — Kusner & Jaffe

(57) ABSTRACT

Disclosed is a spark plug having an insulator with good breakage resistance. A spark plug 1 contains a ceramic insulator 2, a plate packing 22 and a metal shell 3. The ceramic insulator 2 has, on an outer circumferential surface thereof, a step portion 14, a leg portion 13 and a curved surface portion 31 between the step portion 14 and the leg portion 13. The metal shell 3 has, on an inner circumferential surface thereof, a taper portion 21. The ceramic insulator 2 is fixed in the metal shell 3 with the step portion 14 retained on the taper portion 21 via the plate packing 22. Herein, 50% or more of an inner circumferential edge portion IP of the plate packing 22 is in contact with a part of the ceramic insulator 2 located front of a middle region CP of the curved surface portion 31.

11 Claims, 7 Drawing Sheets

(56) References Cited

U.S. PATENT DOCUMENTS

| | | | | |
|---|---|---|---|---|
| 6,094,000 | A * | 7/2000 | Osamura et al. | 313/141 |
| 6,566,793 | B2 * | 5/2003 | Honda et al. | 313/141 |
| 7,183,702 | B2 | 2/2007 | Kanao et al. | 313/118 |
| 2005/0104497 | A1 * | 5/2005 | Fischer et al. | 313/144 |
| 2006/0066196 | A1 * | 3/2006 | Suzuki | 313/143 |
| 2010/0314987 | A1 | 12/2010 | Kyuno et al. | 313/130 |
| 2011/0181168 | A1 | 7/2011 | Nakamura et al. | 313/144 |

FOREIGN PATENT DOCUMENTS

| | | | |
|---|---|---|---|
| JP | 2005243610 | 9/2005 | H01T 13/20 |
| JP | 2006-236906 | 9/2006 | H01T 13/20 |
| JP | 2007-207770 | 8/2007 | F02P 15/00 |
| WO | WO 2009/069796 | 6/2009 | H01T 13/20 |
| WO | WO 2010/035717 | 4/2010 | H01T 13/36 |

OTHER PUBLICATIONS

JIS B 8031: 2006, Japanese Industrial Standard, "Internal Combustion Engines—Spark-plugs," dated 2006; 38 pages.

International Standard, ISO 22977, First edition, Jul. 15, 2005; "Road Vehicles—M12 x 1,25 spark-plugs with Flat Seating and 14mm Bi-hexagon and their Cylinder Head Housing," 12 pages.

Form PCT/ISA/210—Int'l Search Report (from corresponding Int'l Patent App. No. PCT/JP2011/004495-English version only); 2 pages.

* cited by examiner

SPARK PLUG

FIELD OF THE INVENTION

The present invention relates to a spark plug for use in an internal combustion engine.

BACKGROUND OF THE INVENTION

A spark plug is mounted to an internal combustion engine (sometimes just referred to as "engine") and used for ignition of an air-fuel mixture in a combustion chamber of the engine. In general, the spark plug includes an insulator formed with an axial hole, a center electrode inserted in a front side of the axial hole, a terminal electrode inserted in a rear side of the axial hole, a metal shell arranged circumferentially around the insulator and a ground electrode joined to a front end portion of the metal shell so as to define a discharge gap between the center electrode and the ground electrode. With the application of a high voltage to the center electrode, there occurs a spark discharge in the discharge gap between the center and ground electrodes so that the air-fuel mixture can be ignited by the spark discharge.

The insulator is inserted and fixed in the metal shell by crimping an open rear end portion of the metal shell radially inwardly with a step portion of an outer circumferential surface of the insulator retained on a taper portion of an inner circumferential surface of the metal shell. It is common to dispose an annular plate packing between the taper portion of the metal shell and the step portion of the insulator in order to prevent the air-fuel mixture etc. from leaking out to the outside through between the metal shell and the insulator. See, for example, Japanese Laid-Open Patent Publication No. 2005-190762.

In recent high-output engines, there is a tendency that insulators are subjected to larger impacts by vibrations etc. On the other hand, there is a demand to decrease the thickness of insulators for size and diameter reduction of spark plugs. It is therefore difficult to obtain the necessary strength of the insulator to withstand the stress by increasing the thickness of the insulator, even though the stress exerted on the insulator due to impact etc. is increasing. It is particularly likely that, in the insulator, the stress due to impact etc. will be concentrated on a boundary region between the step portion and a leg portion extending toward the front from a front end of the step portion. This results in a greater possibility that cracks occur in such a boundary region between the step portion and the leg portion.

The present invention has been made in view of the above circumstances. It is an advantage of the present invention to provide a spark plug having an insulator capable of achieving good breakage resistance by modifying the shape of the insulator and the state of contact of the insulator with a plate packing without increase in insulator thickness.

SUMMARY OF THE INVENTION

Hereinafter, aspects suitable for achieving the advantages of the present invention will be described below. Specific functions and effects of the respective aspects will also be described below as needed.

Aspect 1.

In accordance with the present invention, there is provided a spark plug, comprising: a cylindrical insulator extending in the direction of an axis of the spark plug; an annular plate packing; and a cylindrical metal shell arranged circumferentially around the insulator. The insulator includes a step portion formed on an outer circumferential surface thereof and has an outer diameter decreasing toward the front in the direction of the axis and a leg portion located front of the step portion and extending toward the front in the direction of the axis. The metal shell includes a taper portion formed on an inner circumferential surface thereof and has an inner diameter decreasing toward the front in the direction of the axis. The insulator is fixed in the metal shell by crimping a rear end portion of the metal shell with the step portion of the insulator retained on the taper portion of the metal shell via the plate packing. The insulator further includes a curved surface portion formed in a concave shape on the outer circumferential surface thereof at a position between the step portion and the leg portion. 50% or more of an inner circumferential edge portion of the plate packing in a circumferential direction thereof is in contact with a part of the insulator located front of a middle region between front and rear ends of the curved surface portion.

Herein, "the middle region of the curved surface portion" means a region located midway between outlines of the curved surface portion when viewed in cross section through the axis.

Aspect 2.

In accordance with another aspect of the present invention, there is provided a spark plug as described above according to aspect 1, wherein the entire circumference of the inner circumferential edge portion of the plate packing is in contact with the part of the insulator located front of the middle region between the front and rear ends of the curved surface portion.

Aspect 3.

In accordance with another aspect of the present invention, there is provided a spark plug as described above according to aspects 1 or 2, wherein the spark plug satisfies a relationship of $0.8 \leq G \leq 1.4$ where G (mm) is a curvature radius of the curved surface portion in a cross section through the axis.

In the case were the curvature radius of the curved surface section is not constant, "the curvature radius G" means, in the cross section through the axis, a curvature radius of an imaginary circle passing through three points: front and rear end points of the curved surface portion and a midpoint of the front and rear end points of the curved surface portion.

Aspect 4.

In accordance with another aspect of the present invention, there is provided a spark plug as described above according to any one of aspects 1 to 3, wherein the insulator includes a cylindrical middle body portion located rear of the step portion and extending in the direction of the axis and a second curved surface portion formed in a convex shape on the outer circumferential surface thereof at a position between the step portion and the middle body portion; and wherein the spark plug satisfies a relationship of $1.0 \leq G/H \leq 3.0$ where, in a cross section through the axis, G (mm) is a curvature radius of the first-mentioned curved surface portion; and H (mm) is a curvature radius of the second curved surface portion.

In the case were the curvature radius of the second curved surface section is not constant, "the curvature radius H" means, in the cross section through the axis, a curvature radius of an imaginary circle passing through three points: front and rear end points of the second curved surface portion and a midpoint of the front and rear end points of the second curved surface portion.

Aspect 5.

In accordance with another aspect of the present invention, there is provided a spark plug as described above according to any one of aspects 1 to 4, wherein the spark plug satisfies a relationship of $\alpha \geq \beta$ where, in the cross section through the axis, $\alpha$ (°) is an acute angle formed by an outline of the step portion and a straight line perpendicular to the axis; and β (°) is an acute angle formed by an outline of the taper portion and a straight line perpendicular to the axis.

Aspect 6.

In accordance with another aspect of the present invention, there is provided a spark plug as described above according to aspect 5, wherein the spark plug satisfies a relationship of $\alpha \leq \beta + 15$ (°).

Aspect 7.

In accordance with another aspect of the present invention, there is provided a spark plug as described above according to any one of aspects 1 to 6, wherein the insulator includes a cylindrical middle body portion that is located rear of the step portion and that extends in the direction of the axis; wherein the spark plug further comprises a center electrode inserted in the insulator and extending in the direction of the axis with a front end of the center electrode located front of a front end of the insulator in the direction of the axis; and wherein the spark plug satisfies relationships of $D/A \leq 1.00$ (mm) and $(B/A)/L \geq 0.20$ ($mm^{-1}$) where A ($mm^2$) is a cross-sectional area of the insulator taken at a front end of the metal shell in a direction perpendicular to the direction of the axis; B ($mm^2$) is a cross-sectional area of the insulator taken at a rear end of the leg portion in a direction perpendicular to the direction of the axis; L (mm) is a length from a boundary region between the middle body portion and the step portion to a front end of the insulator in the direction of the axis; and D ($mm^3$) is a volume of a portion of the center electrode extending from a front end of the center electrode to a position of 1 mm rear from the front end of the insulator.

In the case where the second curved surface portion is formed between the middle body portion and the step portion, "the boundary region between the middle body portion and the step portion" means a region where an imaginary plane extending from the middle body portion toward the front in the direction of the axis intersects an imaginary plane extending from the step portion toward the rear in the direction of the axis.

Aspect 8.

In accordance with another aspect of the present invention, there is provided a spark plug as described above according to any one of aspects 1 to 7, wherein, when a part of the insulator located front of a front end of the metal shell in the direction of the axis is projected onto an imaginary plane parallel to the axis, an area of the projected part is 14.0 $mm^2$ or less.

Aspect 9.

In accordance with another aspect of the present invention, there is provided a spark plug as described above according to any one of aspects 1 to 8, wherein the insulator includes, on a front end portion thereof, a straight region formed into a straight tubular shape of constant outer diameter and having a front end located front of a front end of the metal shell in the direction of the axis.

Aspect 10.

In accordance with another aspect of the present invention, there is provided a spark plug as described above according to aspect 9, wherein the straight region has a rear end located rear of the front end of the metal shell in the direction of the axis.

Tests on factors by which damage is likely to occur in a boundary region between the step portion and the leg portion of the insulator show that the main cause of the damage in the boundary region is that the stress exerted on the insulator by crimping and the stress exerted on the insulator by external force e.g. impact are concentrated onto the boundary region.

In a spark plug according to aspect 1, the curved surface portion is formed between the step portion and the leg portion. The stress exerted on the boundary region by external force can be thus distributed effectively.

Further, the inner circumferential edge portion of the plate packing is in contact with the part of the insulator located front of the middle region of the curved surface portion in the spark plug of aspect 1. As the part of the insulator in contact with the inner circumferential edge portion of the plate packing is most subjected to the stress by crimping, the part of the insulator most subjected to the stress by external force (i.e. the middle region of the curved surface portion and the vicinity thereof) differs in position from the part of the insulator most subjected the stress by crimping. The stress exerted on the insulator can be thus distributed more effectively. The stress exerted on the insulator by crimping and the stress exerted on the insulator by external force can be distributed widely in the circumferential direction as 50% or more of the inner circumferential edge portion of the plate packing in the circumferential direction thereof is in contact with the part of the insulator located front of the middle region of the curved surface portion.

As mentioned above, it is possible in the spark plug of aspect 1 to distribute the stress exerted on the boundary region of the insulator between the step portion and the leg portion very effectively and thereby possible to significantly improve the breakage resistance of the insulator without increasing the thickness of the insulator.

In a spark plug according to aspect 2, the stress exerted on the insulator by crimping and the stress exerted on the insulator by external force can be distributed throughout the entire circumference. It is thus possible to further improve the breakage resistance of the insulator.

In a spark plug according to aspect 3, the curvature radius G of the curved surface portion is set to a relatively large value of 0.8 mm or larger. It is thus possible to more effectively distribute the stress exerted on the curved surface portion by external force and thereby possible to further improve the breakage resistance of the insulator.

When the curvature radius G is too large, the amount of deformation of the taper portion of the metal shell during the crimping is so large that breakage may occur in the insulator. However, the curvature radius G of the curved surface portion is set to 1.4 mm or smaller and is not set to too large a value in the spark plug of aspect 3. It is thus possible to limit deformation of the taper portion during the crimping and prevent breakage of the insulator more assuredly.

In a spark plug according to aspect 4, the second curved surface portion is formed between the step portion and the middle body portion; and the curvature radius H (mm) of the second curved surface portion is set so as to satisfy the relationship of $G/H \leq 3.0$. The stress exerted on the curved surface portion by crimping can be thus reduced.

Further, the curvature radius of the second curved surface portion is set so as to satisfy the relationship of $1.0 \leq G/H$ (that is, $H \leq G$). In this case, the stress is exerted by external force positively on the second curved surface portion of smaller curvature radius. The stress exerted on the first-mentioned curved surface portion by external force can be thus reduced.

As mentioned above, it is possible in the spark plug of aspect 4 to reduce both of the stress exerted on the curved surface portion by crimping and the stress exerted on the curved surface portion by external force and thereby possible to further improve the breakage resistance of the insulator.

When the angle α of the step portion and the angle β of the taper portion are set so as to satisfy the relationship of $\alpha < \beta$, a radially outer region of the step portion is brought into contact with the plate packing. In this case, the curved surface portion is pressed by the middle body portion during the crimping so as to exert a large stress radially inwardly on the curved surface portion. Further, it is likely that the plate packing will be deformed radially inwardly. As a result, there may occur breakage of the insulator as being pressed by the inner circumferential edge portion of the plate packing.

In this point, the angles $\alpha$ and $\beta$ are set so as to satisfy the relationship of $\alpha \geq \beta$ in a spark plug according to aspect 5. The stress exerted radially inwardly on the curved surface portion can be reduced to a sufficiently small degree. Further, the radially inward deformation of the plate packing can be limited assuredly. It is thus possible to further improve the breakage resistance of the insulator and more assuredly prevent breakage of the insulator during the crimping.

The breakage resistance of the insulator can be improved by satisfaction of $\alpha \geq \beta$ as mentioned above. However, only the front end part of the step portion is brought into the plate packing when the angle $\alpha$ is too much larger than the angle $\beta$. In this case, there may occur deterioration of hermeticity due to insufficient contact area between the step portion and the plate packing.

In this point, the angles $\alpha$ and $\beta$ are set so as to satisfy the relationship of $\alpha \leq \beta + 15$ in a spark plug according to aspect 6. As the step portion is radially widely brought into contact with the plate packing, it is possible to exhibit the hermeticity improvement effect of the plate packing sufficiently.

In a spark plug according to aspect 7, the cross-sectional area A of the front end portion of the insulator is set to a sufficiently large value with respect to the volume D of the front end portion of the center electrode upon satisfaction of $D/A \leq 1.00$ (mm). In this case, the front end portion of the insulator has sufficient strength against the weight of the front end portion of the center electrode. Even if the front end portion of the center electrode collides with the insulator by impact etc., it is possible to prevent breakage of the front end portion of the insulator more assuredly.

Further, the cross-sectional area B of the rear end part of the leg portion is set larger than or equal to a value of the length L of the leg portion multiplied by the cross-sectional area A of the front end portion of the ceramic insulator (i.e. a value corresponding to stress that can be exerted to the rear end part of the leg portion by impact etc.) and further multiplied by the factor of 0.2 upon satisfaction of $(B/A)/L \geq 0.20$ (i.e. $B \geq 0.2 \cdot L \cdot A$). As the rear end part of the leg portion has sufficient strength against the stress, it is possible to prevent breakage of the rear end part of the leg portion more assuredly.

In a spark plug according to aspect 8, the impact exerted by knocking etc. on the part of the insulator protruding from the front end of the metal shell can be reduced to a sufficiently small degree. It is thus possible to further reduce the stress on the insulator for further improvement in the breakage resistance of the insulator.

In a spark plug according to aspect 9, the straight region is formed on the front end portion of the insulator. It is thus possible to effectively reduce the impact exerted on the front end portion of the insulator by knocking etc. for further improvement in the breakage resistance of the insulator.

In a spark plug according to aspect 10, it is possible to reduce the impact exerted on the front end portion of the insulator more effectively for further improvement in the breakage resistance of the insulator.

DETAILED DESCRIPTION OF PREFERRED EMBODIMENTS

Figure 1:
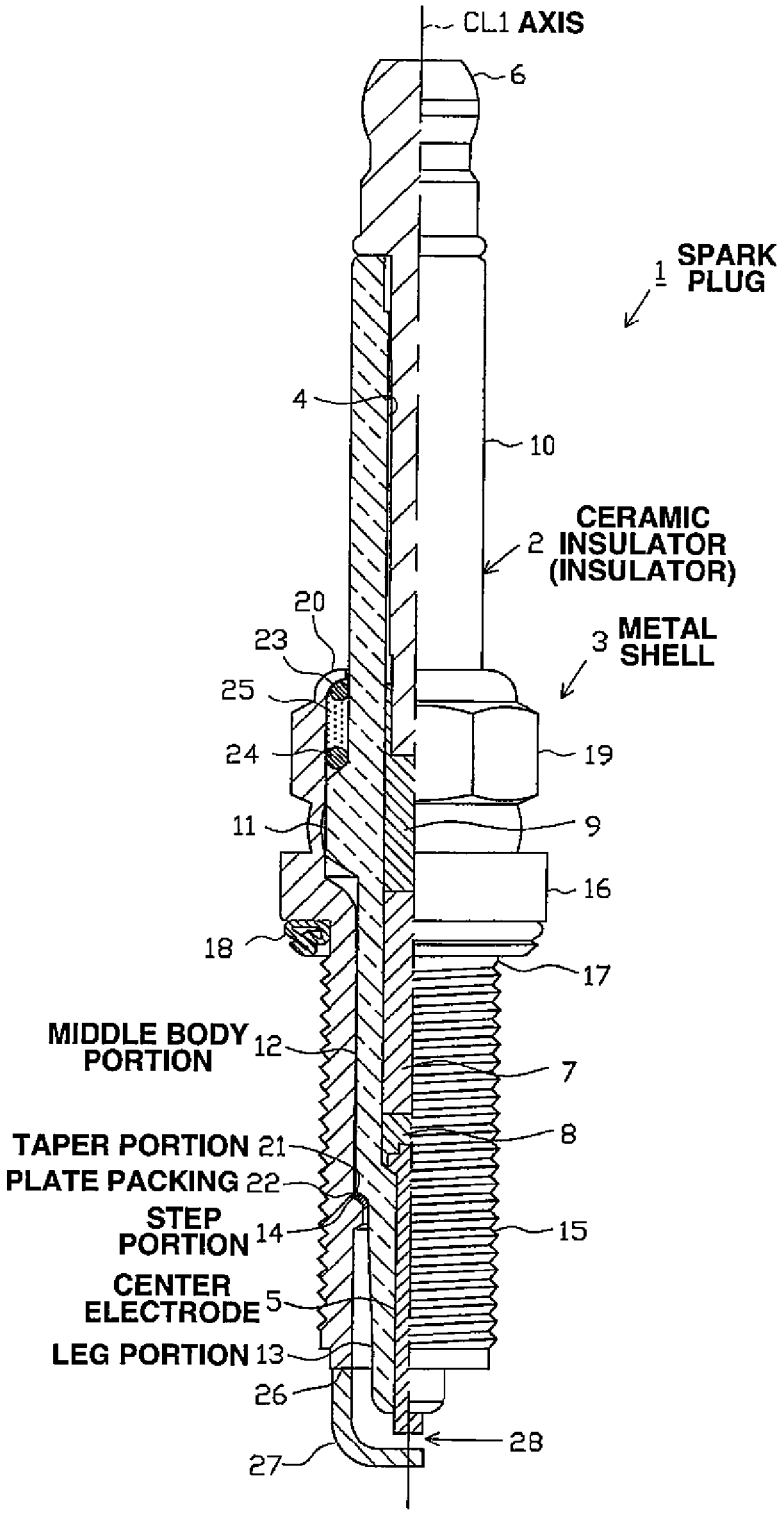
FIG. 1 is a front view, partly in section, of a spark plug according to an embodiment of the present invention.

One exemplary embodiment of the present invention will be described below with reference to the drawings. FIG. 1 is a front view, partly in section, of a spark plug 1 according to one exemplary embodiment of the present invention. It is noted that the direction of an axis CL of the spark plug 1 corresponds to the vertical direction of FIG. 1 where the front and rear side of the spark plug 1 are shown on the bottom and top sides of FIG. 1, respectively.

The spark plug 1 contains a cylindrical ceramic insulator 2 and a cylindrical metal shell 3 holding therein the ceramic insulator 2.

As is generally known, the ceramic insulator 2 is formed of sintered alumina. The ceramic insulator 2 has an outer shape including a rear body portion 10 formed on a rear side thereof. A large-diameter portion 11 is formed front of the rear body portion 10 and protrudes radially outwardly. A middle body portion 12 is formed front of the large-diameter portion 11 and is made smaller in diameter than the large-diameter portion 11. A leg portion 13 is formed front of the middle body portion 12 and is made smaller in diameter than the middle body portion 12. The large-diameter portion 11, the middle body portion 12 and a major part of the leg portion 13 of the ceramic insulator 2 are accommodated in the metal shell 3. The ceramic insulator 2 also has a step portion 14 formed on an outer circumferential surface thereof at a position between the middle body portion 12 and the leg portion 13 in such a manner that an outer diameter of the step portion 14 decreases toward the front in the direction of the axis CL1. The ceramic insulator 2 is held in the metal shell 3 by means of the step portion 14.

An axial hole 4 is formed through the ceramic insulator 2 in the direction of the axis CL1. A center electrode 5 is inserted and fixed in a front side of the axial hole 4. This center electrode 5 is made of Ni alloy (such as Inconel 600 (trademark)) containing nickel (Ni) as a main component and formed as a whole into a rod shape (cylindrical column shape). A front end of the center electrode 5 has a flattened front end face and protrudes from a front end of the ceramic insulator 2. The center electrode 5 may have an inner layer of copper or copper alloy of high thermal conductivity so as to increase the thermal radiation property of the center electrode 5 for improvement in wear resistance.

A terminal electrode 6 is inserted and fixed in a rear side of the axial hole 4 with a rear end portion of the terminal electrode 6 protruding from a rear end of the ceramic insulator 2.

A cylindrical column-shaped resistive element 7 is disposed between the center electrode 5 and the terminal electrode 6 within the axial hole 4 and is electrically connected at opposite ends thereof to the center electrode 5 and the terminal electrode 6 through conductive glass seal layers 8 and 9, respectively.

The metal shell 3 is made of metal such as low carbon steel and formed into a cylindrical shape. The metal shell 3 has, on an outer circumferential surface thereof, a thread portion (male thread portion) 15 formed for mounting the spark plug 1 onto a combustion apparatus (such as an internal combustion engine, a fuel cell processing device etc.) and a seat portion 16 formed rear of the thread portion 15. A ring-shaped gasket 18 is fitted around a thread neck 17 on a rear end of the thread portion 15. The metal shell 3 also has, on a rear end side thereof, a tool engagement portion 19 formed into a hexagonal cross section for engagement with a tool such as wrench for mounting the spark plug 1 onto the combustion apparatus and a crimped portion 20 formed to hold the ceramic insulator 2. In the present embodiment, the spark plug 1 is downsized to a level that the thread portion 15 has a relatively small thread diameter size (e.g. M12 or smaller).

The metal shell 3 has, on an inner circumferential thereof, a taper portion 21 formed in such a manner that an inner diameter of the taper portion 21 decreases toward the front in the direction of the axis CL1. The ceramic insulator 2 is inserted in the metal shell 3 from the rear toward the front and fixed in the metal shell 3 by crimping an open rear end portion of the metal shell 3 radially inwardly, with the step portion 14 of the ceramic insulator 2 retained on the taper portion 21 of the metal shell 3, and thereby forming the crimped portion 20. Further, the spark plug 1 contains an annular plate packing 22 held between the step portion 14 of the ceramic insulator 2 and the taper portion 21 of the metal shell 3 so as to maintain airtightness for the combustion chamber and prevent fuel gas from leaking to the outside through a space between the inner circumferential surface of the metal shell 3 and the leg portion 13 of the ceramic insulator 2 exposed to the combustion chamber.

In order to secure a more complete seal by crimping, annular ring members 23 and 24 are disposed between the metal shell 3 and the ceramic insulator 2 within the rear end portion of the metal shell 3; and a powder of talc 25 is filled in between the ring members 23 and 34. In other words, the metal shell 3 holds therein the ceramic insulator 2 via the plate packing 22, the ring members 23 and 24 and the talc 25.

A ground electrode 27 is joined to a front end portion 26 of the metal shell 3 and bent at a middle portion thereof in such a manner that a distal end portion of the ground electrode 27 has a lateral surface facing the front end face of the center electrode 5. There is thus defined a discharge gap 28 between the front end portion of the center electrode 5 and the distal end portion of the ground electrode 27 so that a spark discharge occurs substantially along the direction of the axis CL within the discharge gap 28.

Figure 2:
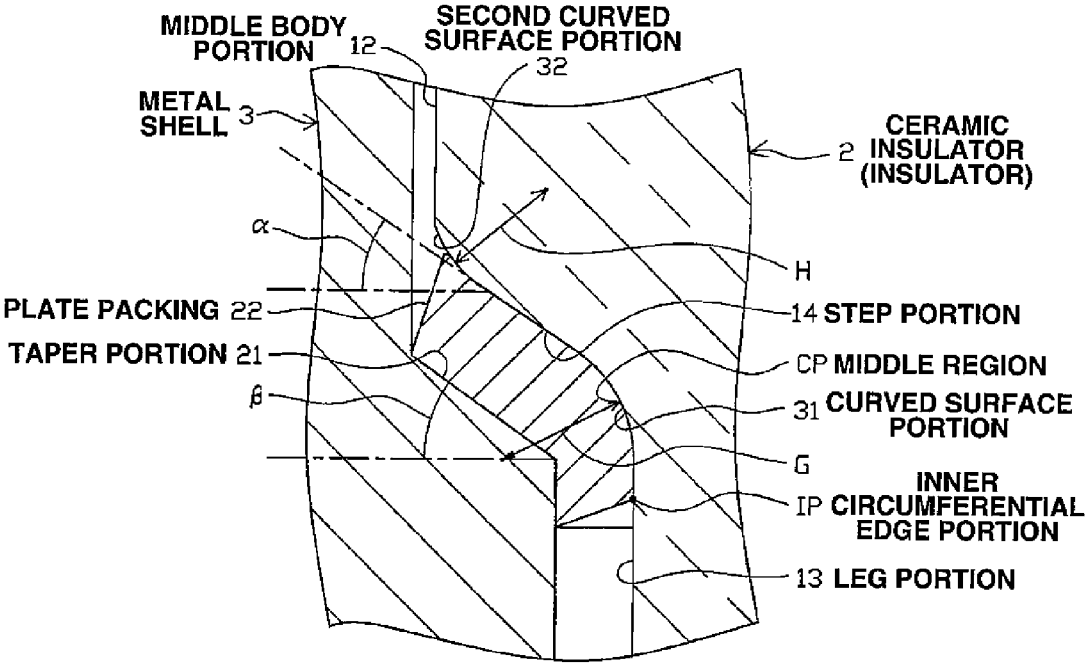
FIG. 2 is an enlarged section view of a part of the spark plug including a plate packing and a step portion of an insulator etc.
Figure 3:
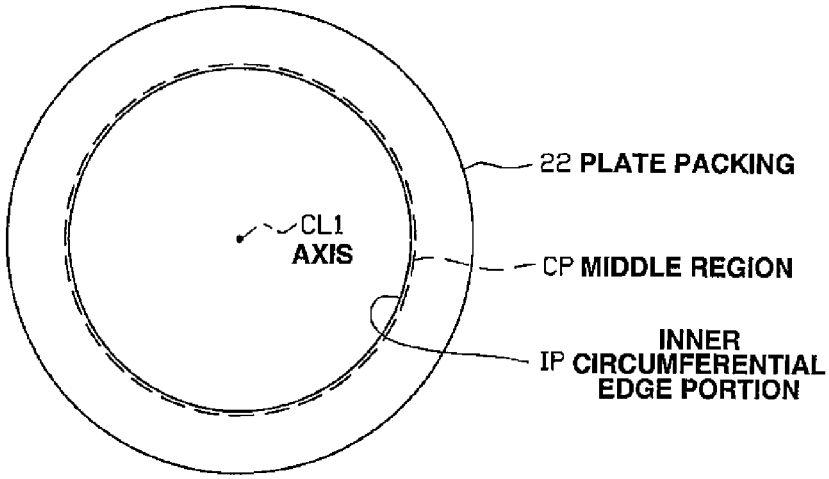
FIG. 3 is a perspective view showing one example of the positional relationship between a middle region of a curved surface portion of the insulator and an inner circumferential edge portion of the plate packing.

In the present embodiment, the ceramic insulator 2 has, at the outer circumferential surface thereof, a curved surface portion 31 formed into a concave shape at a position between the step portion 14 and the leg portion 13 and a second curved surface portion 32 formed into a convex shape at a position between the step portion 14 and the middle body portion 12 as shown in FIG. 2. As shown in FIG. 3, the entire circumference of an inner circumferential edge portion IP of the plate packing 22 is in contact with a part of the ceramic insulator 2 located front of a middle region CP between front and rear ends of the curved surface portion 31. (FIG. 3 is a schematic projection view of the plate packing 22 etc. as viewed from the front side in the direction of the axis CL1.) That is, the inner circumferential edge portion IP is located inside the middle region CP.

Figure 4:
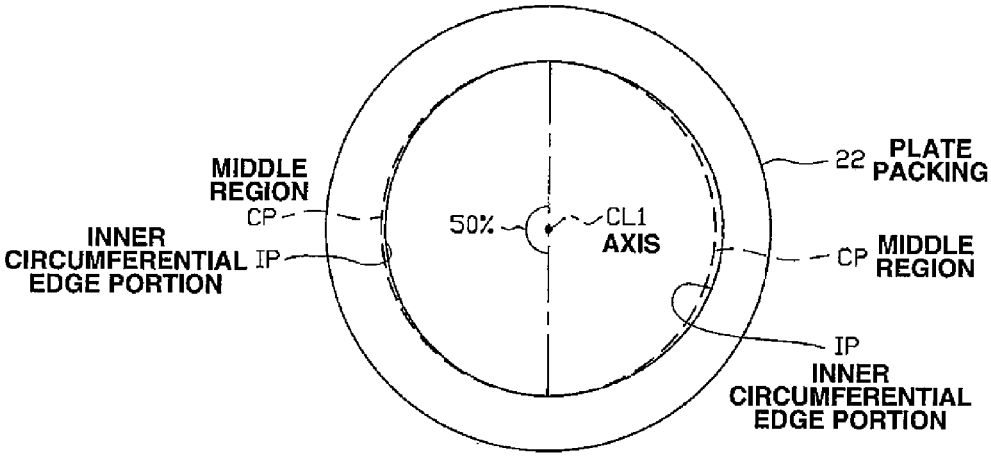
FIG. 4 is a perspective view showing another example of the positional relationship between the middle region of the curved surface portion of the insulator and the inner circumferential edge portion of the plate packing.
Figure 5:
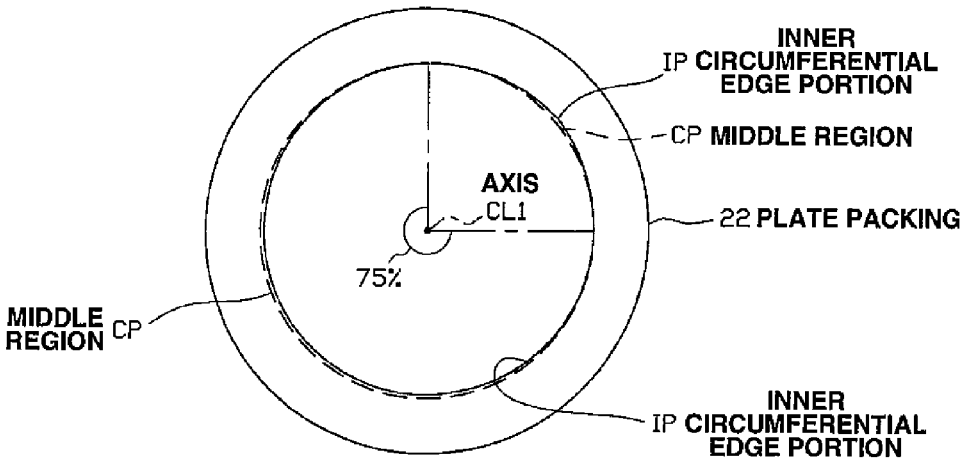
FIG. 5 is a perspective view showing still another example of the positional relationship between the middle region of the curved surface portion of the insulator and the inner circumferential edge portion of the plate packing.

The entire circumference of the inner circumferential edge portion IP is not necessarily in contact with the part of the ceramic insulator 2 located front of the middle region CP. It suffices that 50% or more of the inner circumferential edge portion IP in a circumferential direction thereof is in contact with the part of the ceramic insulator 2 located front of the middle region CP. For example, 50% of the inner circumferential edge portion IP in the circumferential direction may be in contact with the part of the ceramic insulator 2 located front of the middle region CP as shown in FIG. 4. As shown in FIG. 5, 75% of the inner circumferential edge portion IP in the circumferential direction may be in contact with the part of the ceramic insulator 2 located front of the middle region CP.

As also shown in FIG. 2, the spark plug 1 is adapted to satisfy a relationship of $0.8 \leq G \leq 1.4$ where G (mm) is a curvature radius of the curved surface portion 31 in a cross section through the axis CL1. The spark plug 1 is further adapted to satisfy a relationship of $1.0 \leq G/H \leq 3.0$ where, in the cross section through the axis CL1, H (mm) is a curvature radius of the second curved surface portion 32. The curvature radius of the curved surface portion 31 and the curvature radius of the second curved surface portion 32 are set constant in the present embodiment.

Furthermore, the spark plug 1 is adapted to satisfy not only a relationship of $\alpha \geq \beta$ but also a relationship of $\alpha \leq \beta + 15$ where, in the cross section through the axis CL1, $\alpha$ (°) is an acute angle formed by an outline of the step portion 14 and a straight line perpendicular to the axis CL1 and $\beta$ (°) is an acute angle formed by an outline of the taper portion 21 and a straight line perpendicular to the axis CL1.

Figure 6:
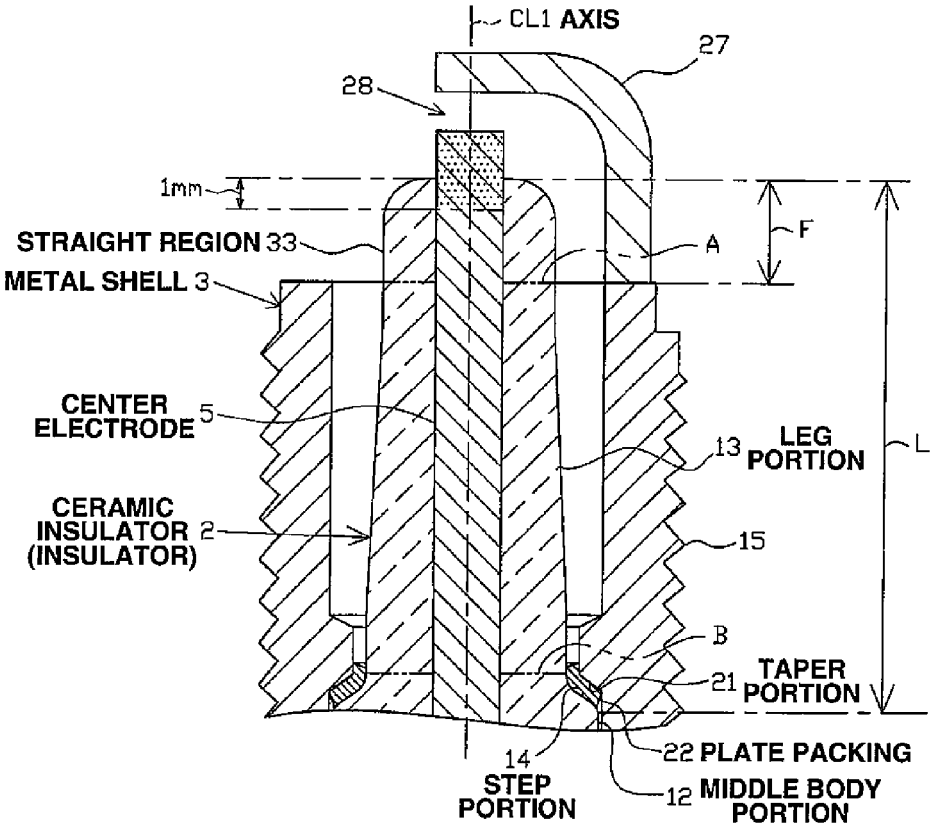
FIG. 6 is an enlarged section view of a front end part of the spark plug.

As shown in FIG. 6, the spark plug 1 is also adapted to satisfy relationships of $D/A \leq 1.00$ (mm) and $(B/A)/L \geq 0.20$ ($mm^{-1}$) where A ($mm^2$) is a cross-sectional area of the ceramic insulator 2 taken at a front end of the metal shell 3 in a direction perpendicular to the direction of the axis CL1; B ($mm^2$) is a cross-sectional area of the ceramic insulator 2 taken at a rear end of the leg portion 13 in a direction perpendicular to the direction of the axis CL1; L (mm) is a length from a boundary region between the middle body portion 12 and the step portion 14 (i.e. a middle region of the second curved surface portion 32 in the present embodiment) to the front end of the ceramic insulator 2 in the direction of the axis CL1; and D ($mm^3$) is a volume of a portion of the center electrode 5 extending from the front end of the center electrode 5 to a position of 1 mm rear from the front end of the ceramic insulator 2 (as indicated by dot hatching in FIG. 6).

Namely, the cross-sectional area A of the front end portion of the ceramic insulator 2 is set to a sufficiently large value with respect to the volume of the front end portion of the center electrode 5 upon satisfaction of D/A≤1.00; and the cross-sectional area B of the rear end part of the leg portion 13 is set larger than or equal to a value of the length L of the leg portion 13 multiplied by the cross-sectional area A of the front end portion of the ceramic insulator 2 (i.e. a value corresponding to stress that can be exerted to the rear end part of the leg portion 13 by impact etc.) and further multiplied by the factor of 0.2 upon satisfaction of (B/A)/L≥0.20 (i.e. B≥0.2·L·A).

In the present embodiment, the length F of protrusion of the front end of the ceramic insulator 2 from the front end of the metal shell 3 is set to a relatively small value of 5 mm or less for the purpose of preventing overheating of the front end portion of the ceramic insulator 2.

Figure 7:
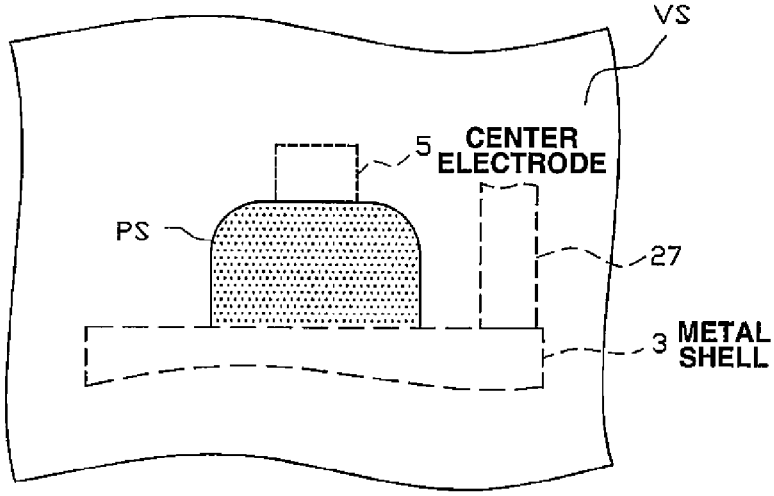
FIG. 7 is a projected view of the spark plug as projected onto an imaginary plane.

When a part of the ceramic insulator 2 located front of the front end of the metal shell 3 in the direction of the axis CL1 is projected onto an imaginary plane VS parallel to the axis CL1 as shown in FIG. 7, the projected part PS (as indicated by dot hatching in FIG. 7) has a relatively small area of 14.0 $mm^2$ or less.

Figure 8:
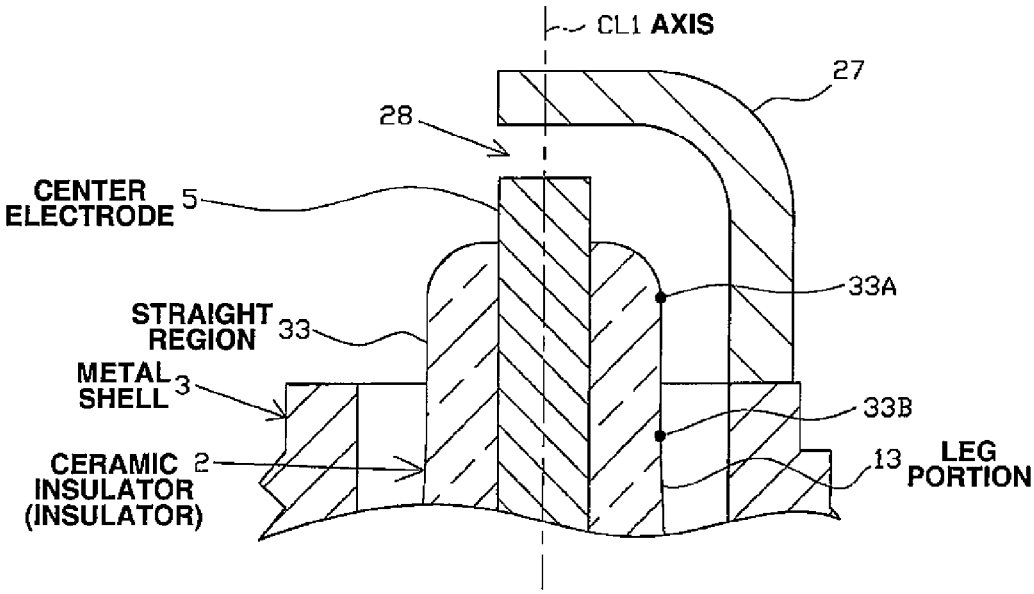
FIG. 8 is a schematic section view showing the position of formation of a straight region on the insulator.

Further, a straight-tubular straight region 33 of constant outer diameter is formed on the front end portion of the ceramic insulator 2 as shown in FIG. 8. A front end 33A of the straight region 33 is located front of the front end of the metal shell 3 in the direction of the axis CL1, whereas a rear end 33B of the straight region 33 is located rear of the front end of the metal shell 3 in the direction of the axis CL1.

A manufacturing method of the above-structured spark plug 1 will be described below.

The metal shell 3 is first produced. More specifically, a semifinished metal shell member is produced by cold forging a cylindrical column-shaped metal material (such as iron-based material e.g. S17C or S25C or stainless steel material) to form a through hole in the metal material and to form the metal material into a general shape, and then, cutting the outside shape of the metal material.

The ground electrode 27 of Ni alloy material is provided in straight rod form and joined by resistance welding to a front end face of the semifinished metal shell member. Burrs occur during the welding. After removing the welding buns, the thread portion 15 is formed by component rolling on a given area of the semifinished metal shell member. The resulting metal shell 3 to which the ground electrode 27 has been welded is subjected to zinc plating or nickel plating and may further be subjected to chromate surface treatment for improvement in corrosion resistance.

The ceramic insulator 2 is produced by molding separately from the metal shell 3. For example, it is feasible to produce the ceramic insulator 2 by preparing a granulated molding material from an alumina-based raw powder with a binder, rubber-press molding the prepared material into a cylindrical body, shaping by cutting the outside shape of the molded body, and then, sintering the molded body.

The center electrode 5 is also produced by forging a Ni alloy material.

Further, the annular plate packing 22 is produced by die-cutting a soft steel sheet softer than the metal material of the metal shell 3, and then, performing carburizing or carbonitriding treatment onto the die-cut material. The plate packing 22 is herein formed with a relatively small inner diameter (as small as the outer diameter of the rear end of the leg portion 13). Further, the plate packing 22 is substantially plate-shaped before assembling.

The ceramic insulator 2, the center electrode 5, the resistive element 7 and the terminal electrode 6 are fixed together by the glass seal layers 8 and 9. In general, a material of the glass seal layer 8, 9 is prepared by mixing borosilicate glass with a metal powder. The prepared material is filled into the axial hole 4 of the ceramic insulator 2 in such a manner as to sandwich therebetween the resistive element 7. The filled material is solidified by sintering in a sintering furnace with the terminal electrode 6 pressed into the prepared material from the rear. At this time, a glazing layer may be formed simultaneously, or in advance, on a surface of the rear body portion 10 of the ceramic insulator 2.

After that, the ceramic insulator 2 is fixed in the metal shell 3 by placing the plate packing 22 on the taper portion 21, inserting the ceramic insulator 2 through the open rear end portion of the metal shell 3, pressing the rear end portion of the metal shell 3 toward the front in the direction of the axis CL1 with the use of a predetermined jig having a recessed portion corresponding in shape to the crimped portion 20 and thereby crimping the rear end portion of the metal shell 3 radially inwardly (i.e. forming the crimped portion 20). By this crimping process, the substantially plate-shaped plate packing 22 is crushed and deformed along the step portion 14 and the taper portion 21 so as to allow adhesion of the plate packing 22 to the step portion 14 and the taper portion 21 and to bring the entire inner circumferential edge portion IP of the plate packing 22 into contact with the part of the ceramic insulator 2 located front of the middle region CP.

The ground electrode 27 is bent at the substantially middle portion thereof, thereby defining and adjusting the discharge gap 28 between the center electrode 5 and the ground electrode 27. In this way, the spark plug 1 is completed.

As described above, the curved surface portion 31 is formed between the step portion 14 and the leg portion 13 in the present embodiment. The stress exerted on the curved surface portion 31 by external force can be thus distributed effectively.

Further, the inner circumferential edge portion IP of the plate packing 22 is in contact with the part of the ceramic insulator 2 located front of the middle region CP of the curved surface portion 31. As the part of the ceramic insulator 2 in contact with the inner circumferential edge portion IP of the plate packing 22 is most subjected to the stress by crimping, the part of the ceramic insulator 2 most subjected to the stress by external force (i.e. the middle region CP of the curved surface portion 31 and the vicinity thereof) differs in position from the part of the ceramic insulator 2 most subjected the stress by crimping. The stress exerted on the ceramic insulator 2 can be thus distributed more effectively. In the present embodiment, the entire circumference of the inner circumferential edge portion IP of the plate packing 22 is in contact with the part of the ceramic insulator 2 located front of the middle region CP of the curved surface portion 31. Both of the stress exerted on the ceramic insulator 2 by crimping and the stress exerted on the ceramic insulator 2 by external force can be thus distributed throughout the entire circumference.

It is therefore possible in the present embodiment to distribute the stress exerted on the boundary region of the ceramic insulator 2 between the step portion 14 and the leg portion 13 very effectively and significantly improve the breakage resistance of the ceramic insulator 2 without increasing the thickness of the ceramic insulator 2. The present invention is particularly significant for the spark plug 1 where the thread portion 15 has such a relatively small thread diameter size as in the present embodiment that it is difficult to increase the thickness of the ceramic insulator 2.

As the curvature radius G of the curved surface portion 31 is set to a relatively large value of 0.8 mm or larger, it is possible to more effectively distribute the stress exerted on the curved surface portion 31 by external force and further improve the breakage resistance of the ceramic insulator 12. It is also possible to limit deformation of the taper portion 21 during the crimping and prevent breakage of the ceramic insulator 2 more assuredly as the curvature radius G of the curved surface portion 31 is set to 1.4 mm or smaller.

The second curved surface portion 32 is also formed between the step portion 14 and the middle body portion 12; and the curvature radius H (mm) of the second curved surface portion 32 is set so as to satisfy $G/H \leq 3.0$. It is thus possible to reduce both of the stress exerted on the curved surface portion 31 by crimping and the stress exerted on the curved surface portion 31 by external force and further improves the breakage resistance of the ceramic insulator 2.

The angles $\alpha$ and $\beta$ are set so as to satisfy $\alpha \geq \beta$. In this case, the stress exerted radially inwardly on the curved surface portion 31 can be reduced to a sufficiently small degree. Further, the radially inward deformation of the plate packing 22 can be limited assuredly. It is thus possible to further improve the breakage resistance of the ceramic insulator 2 and more assuredly prevent breakage of the ceramic insulator 2 during the crimping. On the other hand, the angles $\alpha$ and $\beta$ are set so as to satisfy $\alpha \leq \beta+15$. As the step portion 14 is radially widely brought into contact with the plate packing 22, it is possible to exhibit the airtightness improvement effect of the plate packing 22 sufficiently.

Upon satisfaction of $D/A \leq 1.00$ (mm), the cross sectional area A of the front end portion of the ceramic insulator 2 is set to a sufficiently large value with respect to the volume D of the front end portion of the center electrode 5. In this case, the front end portion of the ceramic insulator 2 has sufficient strength against the weight of the front end portion of the center electrode 5. It is thus possible to prevent breakage of the front end portion of the ceramic insulator 2 more assuredly. It is also possible to prevent breakage of the rear end part of the leg portion 13 more assuredly as the rear end part of the leg portion 13 has sufficient strength against the stress upon satisfaction of $(B/A)/L \geq 0.20$ (i.e. $B \geq 0.2 \cdot L \cdot A$).

As the area of the projected part PS is set to be 14.0 $mm^2$ or less, the impact exerted by knocking etc. on the part of the ceramic insulator 2 protruding from the front end of the metal shell 3 can be reduced to a sufficiently small degree. It is thus possible to further reduce the stress on the ceramic insulator 2 and improve the breakage resistance of the ceramic insulator 2.

Moreover, the straight region 33 is formed on the front end portion of the ceramic insulator 2 in such a manner that the rear end 33B of the straight region 33 is located rear of the front end of the metal shell 3. It is thus possible to further reduce the impact exerted on the front end portion of the ceramic insulator 2 and improve the breakage resistance of the ceramic insulator 2.

In order to verify the functions and effects of the above embodiment, a plurality of spark plug samples in which the rate of circumferential contact of the inner circumferential edge portion of the plate packing with the part of the ceramic insulator located front of the middle region was set to 0%, 50% or 100% were prepared and each tested by bending test. The bending test was herein performed by the following procedure. Using a predetermined autograph, a load was applied to the front end portion of the ceramic insulator from three circumferentially different directions perpendicular to the direction of the axis. (As used herein, the term "autograph" is an abbreviation for a high performance universal testing machine (tension/compression tester) "Autograph Series" available from Shimadzu Corporation). The load at which breakage occurred in the ceramic insulator (called "breaking load") was measured. Breaking load measurement values and average values of the respective samples are listed in TABLE 1. In every sample, the curvature radius G of the curved surface portion was set to 0.5 mm; the curvature radius H of the second curved surface portion was set to 0.2 mm; and the outer diameter of the rear end part of the leg portion was set to 5.3 mm. Further, the contact rate was adjusted by controlling the conditions of formation of the crimped portion (e.g. the load applied to the rear end portion of the metal shell).

TABLE 1

| Contact rate | Breaking load (N) | | | Average value (N) |
|---|---|---|---|---|
| 0% | 550 | 560 | 540 | 550 |
| 50% | 700 | 560 | 690 | 650 |
| 100% | 710 | 700 | 690 | 700 |

As shown in TABLE 1, the breaking load average value was significantly increased to show good breakage resistance in each of the samples where the contact rate was 50% or higher. The reasons for this are assumed as follows: (1) it was possible by the formation of the curved surface portion to distribute the stress exerted by external force on the boundary region between the step portion and the leg portion without concentrating the stress onto one region: (2) by the contact of the plate packing with the part of the ceramic insulator located front of the middle region of the curved surface portion, it was possible to distribute the stress more effectively because the part of the ceramic insulator in contact with the inner circumferential edge portion of the plate packing was most subjected to the stress by crimping so that the part of the ceramic insulator most subjected to the stress by external force was different in position from the part of the ceramic insulator most subjected the stress by crimping; and (3) it was possible to attain the effect of the above item (2) over the wide circumferential range by setting the contact rate to 50% or more.

In particular, the sample where the contact rate was 100% had better breakage resistance. The reason is assumed that it was possible to distribute the stress assuredly even under the application of the external force in different directions because the part of the ceramic insulator most subjected to the stress by external force and the part of the ceramic insulator most subjected the stress were different in position throughout the entire circumference.

It has been shown by the above test results that: it is preferable that 50% or more of the inner circumferential edge portion of the plate packing in the circumferential direction is in contact with the part of the ceramic insulator located front of the middle region of the curved surface portion for the purpose of improving the breakage resistance of the ceramic insulator. It has also been shown that, for the purpose of further improving the breakage resistance of the ceramic insulator, it is particularly preferable that the entire circumference of the inner circumferential edge portion is in contact with the part of the ceramic insulator located front of the middle region of the curved surface portion.

Figure 9:
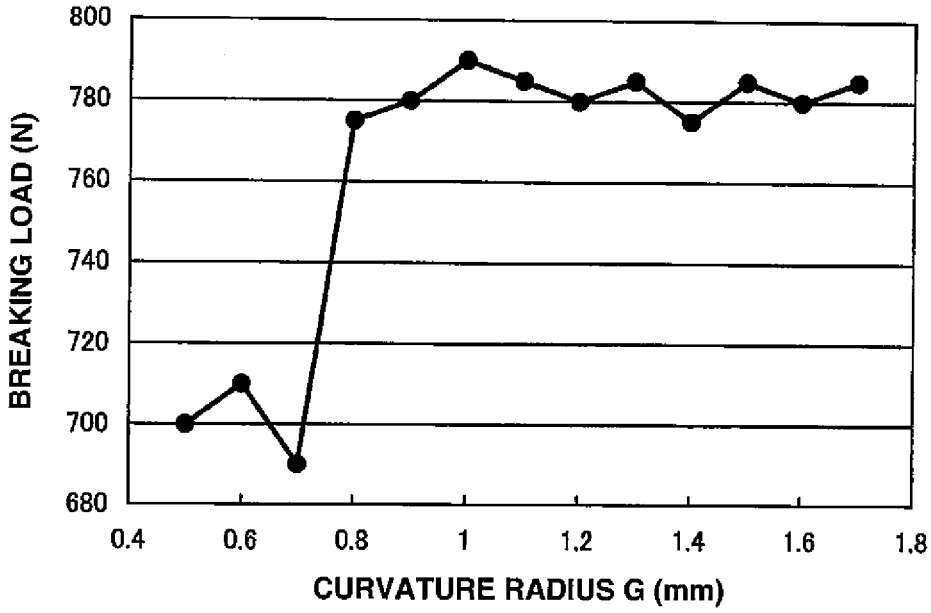
FIG. 9 is a graph showing the results of bending test on spark plug samples having curved surface portions of various curvature radii G.

A plurality of spark plug samples in which the curvature radius G (mm) of the curved surface potion was set to various values were prepared and each tested by the same bending test as above. The test results are indicated in FIG. 9. In every sample, the contact rate was set to 100%. The breaking load was measured under the application of a load in one given direction by a predetermined autograph.

Each of the samples where the curvature radius G of the curved surface portion was 0.8 mm or larger had better breakage resistance as shown in FIG. 9. The reason for this is assumed that it was possible to more effectively distribute the stress exerted on the curved surface portion by external force by setting the curvature radius G to a relatively large value.

Figure 10:
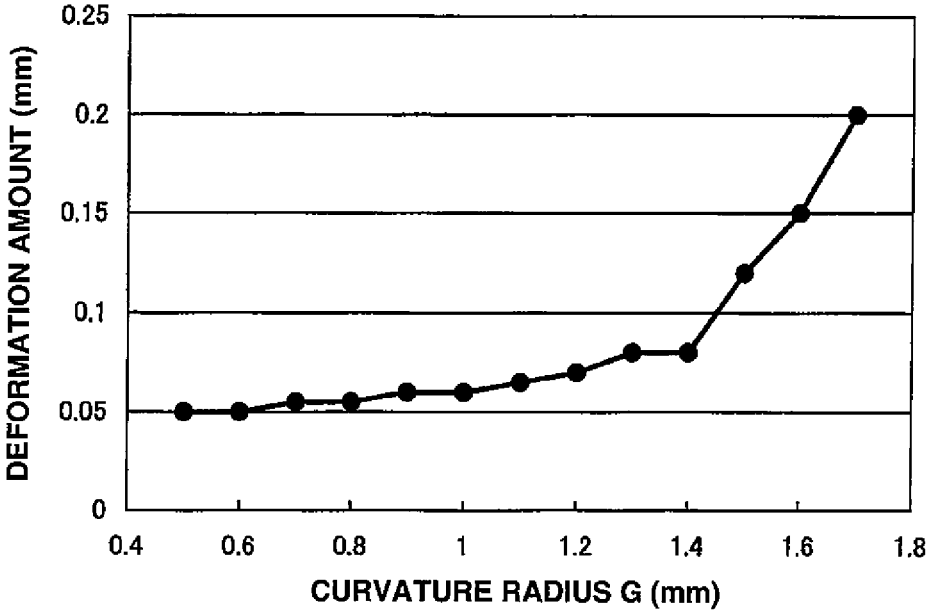
FIG. 10 is a graph showing the amount of deformation of taper portion in each of spark plug samples having curved surface portions of various curvature radii G.

Next, a plurality of ceramic insulator samples where the curvature radius G (mm) was set to various values were prepared and each tested for the amount of deformation of the taper portion after fixing the ceramic insulator by crimping to the metal shell. The relationship of the curvature radius G and the amount of deformation of the taper portion is indicated in FIG. 10. The amount of deformation of the taper portion refers to the amount of deformation of the taper portion along the direction of axis after the crimping with respect to the taper portion before the crimping and was determined by cross-sectional observation of the metal shell.

As shown in FIG. 10, it was possible to effectively limit the deformation of the taper portion during the crimping for prevention of breakage of the ceramic insulator by setting the curvature radius G to be 1.4 mm or smaller.

It has been shown by the above test results that it is preferable to set the curvature radius G of the curved surface portion to be 0.8 to 1.4 mm for the purpose of further improving the breakage resistance of the ceramic insulator and limiting the deformation of the taper portion.

Figure 11:
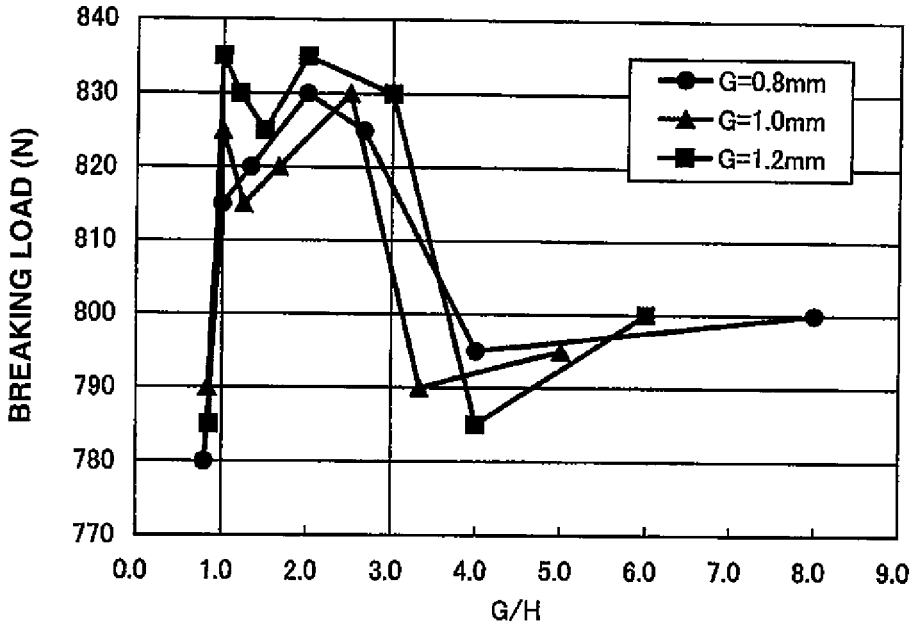
FIG. 11 is a graph showing the results of bending test on spark plug samples of various G/H.

A plurality of spark plug samples in which the value G/H was varied by setting the curvature radius G of the curved surface portion to 0.8 mm, 1.0 mm or 1.2 mm and setting the curvature radius H (mm) of the second curved surface portion to various values were prepared and each tested by bending test. The test results are indicated in FIG. 11. In FIG. 11, the test results of the samples where the curvature radius G was 0.8 mm are plotted with circles; the test results of the samples where the curvature radius G was 1.0 mm are plotted with triangles; and the test results of the samples where the curvature radius G was 1.2 mm are plotted with squares. In every sample, the contact rate was set to 100%; and the outer diameter of the rear end part of the leg portion was set to 5.3 mm. The breaking load was measured under the application of a load in one given direction by a predetermined autograph in the test.

Each of the samples where the relationship of $1.0 \leq G/H \leq 3.0$ was satisfied had better breakage resistance as shown in FIG. 11. The reasons for this are assumed as follows: it was possible by satisfaction of $G/H \leq 3.0$ to reduce the stress exerted by crimping on the curved surface portion; and it was possible by satisfaction of $1.0 \leq G/H$ (i.e. $H \leq G$) to positively exert the stress by external force on the second curved surface portion and thereby reduce the stress exerted by external force on the curved surface portion.

It has been shown by the above test results that it is preferable to set the curvature radii G and H in such a manner as to satisfy the relationship of $1.0 \leq G/H \leq 3.0$ for the purpose of further improving the breakage resistance of the ceramic insulator.

A plurality of spark plug samples in which the value $\alpha$-$\beta$ (°) was varied by changing the angle $\alpha$ of the step portion of the ceramic insulator and setting the angle $\beta$ of the taper portion to 30° were prepared and each tested by the same bending test as above and by airtightness test according to JIS B 8031.

The airtightness test was herein performed by the following procedure. The spark plug samples of various $\alpha$-$\beta$ (°), 10 samples for each $\alpha$-$\beta$ (°), were prepared. Each of the samples was placed in a predetermined chamber and maintained in an atmosphere of 150° C. for 30 minutes. After that, an air pressure of 1.5 MPa was applied to a front end part of the sample. The occurrence or non-occurrence of air leak through between the ceramic insulator and the metal shell was checked. The number of the samples in which the air leak occurred (called "leakage sample number"), out of the 10 samples, was measured. The airtightness was evaluated as good and marked with "○" when no air leak occurred in all of the 10 samples. On the other hand, the airtightness was evaluated as rather poor and marked with "Δ" when the leakage sample number was 1 to 5.

Further, ceramic insulators of various angles $\alpha$ were tested by crimping test. The crimping test was herein performed by the following procedure. The ceramic insulators of various angles $\alpha$, 10 samples for each angle $\alpha$, were prepared. Each of the ceramic insulators was fixed by crimping to the metal shell in which the angle $\beta$ of the taper portion was set to 30°. The occurrence or non-occurrence of breakage in the ceramic insulator after the crimping was checked. The number of the samples in which the breakage occurred in the ceramic insulator (called "breakage sample number"), out of the 10 samples, was measured. The evaluation result "○" was given when no breakage occurred in all of the 10 samples, whereas the evaluation result "Δ" was given when the breakage sample number was 1 to 5.

Figure 12:
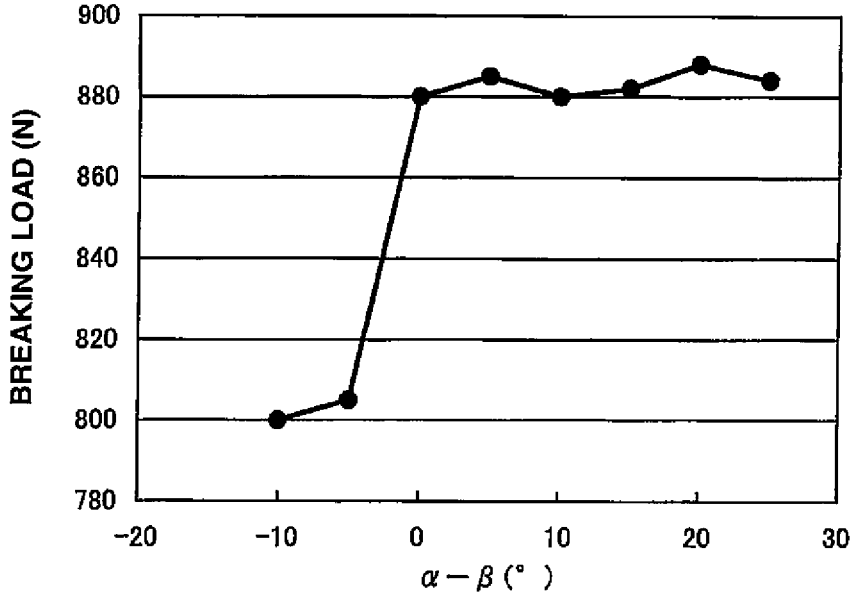
FIG. 12 is a graph showing the results of bending test on spark plug samples of various $\alpha$ and $\beta$.

The test results of the bending test are indicated in FIG. 12. The test results of the airtightness test and the test results of the crimping test are indicated in TABLE 2. In every sample, the contact rate was set to 100%; the curvature radius G of the curved surface portion was set to 0.8 mm; and the curvature radius H of the second curved surface portion was set to 0.4 mm.

TABLE 2

| Angle $\alpha$ (°) | $\alpha$-$\beta$ (°) | Airtightness test evaluation result | Crimping test evaluation result |
|---|---|---|---|
| 20 | −10 | ○ | Δ |
| 25 | −5 | ○ | Δ |
| 30 | 0 | ○ | ○ |
| 35 | 5 | ○ | ○ |
| 40 | 10 | ○ | ○ |
| 45 | 15 | ○ | ○ |
| 50 | 20 | Δ | ○ |
| 55 | 25 | Δ | ○ |

As shown in FIG. 12 and TABLE 2, the breaking load was lower in the samples where $\alpha$-$\beta$ was set to a negative value (i.e. $\alpha<\beta$) than in the other samples. Further, the breakage was likely to occur by crimping in the ceramic insulator in these samples. The reasons for this are assumed that: the curved surface portion was pressed by the middle body portion during the crimping so as to exert a large stress radially inwardly on the curved surface portion; and the inner circumferential edge portion of the plate packing was readily radially inwardly deformed.

Further, the airtightness was rather poor in the samples where $\alpha$-$\beta$ was set to be larger than 15° (i.e. $\alpha>\beta+15$). The reason for this is assumed that the contact area between the step portion and the plate packing was not secured sufficiently as only the front end part of the step portion was in contact with the plate packing.

By contrast, each of the samples where the relationship of $\alpha \geq \beta$ was satisfied had better breakage resistance; and each of the samples where the relationship of $\alpha \leq \beta+15$ was satisfied had good airtightness.

It has thus been shown by the above test results that it is preferable to set the angles $\alpha$ and $\beta$ in such a manner as to satisfy the relationship of $\alpha \geq \beta$ for the purpose of further improvement in the breakage resistance of the ceramic insulator.

It has also been shown that it is preferable to set the angles $\alpha$ and $\beta$ in such a manner as to satisfy the relationship of $\alpha \leq \beta+15$ for the purpose of securing good airtightness.

Next, spark plug samples in which the sizes of the ceramic insulator and the center electrode were adjusted to vary the cross-sectional area A ($mm^2$) of the ceramic insulator taken at the front end of the metal shell in the direction perpendicular to the direction of the axis (referred to as "front end cross-sectional area"), the cross-sectional area B ($mm^2$) of the ceramic insulator taken at the rear end of the leg portion in the direction perpendicular to the direction of the axis (referred to as "rear end cross-sectional area"), the length L (mm) from the boundary region of the middle body portion and the step portion to the front end of the ceramic insulator in the direction of the axis (referred to as "leg length") and the volume of the portion of the center electrode from the front end of the center electrode to a position of 1 mm rear from the front end of the ceramic insulator (referred to as "electrode front end volume"). 10 samples for each combination of A, B, L and D were prepared and each tested by impact resistance test. The impact resistance test was herein performed by the following procedure. Each of the samples was fixed to a L-shaped bushing. An impact was applied to a front end part of the sample under the conditions of an oscillation amplitude of 22 mm and a rate of 400 times per minute by an impact test machine according to Section 7.4 of JIS B 8031. After lapse of 3 hours, the occurrence or non-occurrence of cracks in the front end rear end parts of the leg portion was checked. The number of the samples in which the cracks occurred in the leg portion (called "crack sample number") was measured. The impact resistance was evaluated as good and marked with "○" when no cracks occurred in all of the 10 samples. On the other hand, the impact resistance was evaluated as rather poor and marked with "Δ" when the crack sample number was 1 to 5. The test results are indicated in TABLE 3. The evaluation was made on the front and rear end parts of the leg portion separately. In every sample, the contact rate was set to 100%; the curvature radius G of the curved surface portion was set to 1.0 mm; and the curvature radius H of the second curved surface portion was set to 0.4 mm.

TABLE 3

| Leg length L (mm) | Front end cross-sectional area ($mm^2$) | Rear end cross-sectional area ($mm^2$) | Electrode front end volume ($mm^3$) | D/A (mm) | (B/A)/L ($mm^{-1}$) | Evaluation result: Front end part | Evaluation result: Rear end part |
|---|---|---|---|---|---|---|---|
| 20 | 9.48 | 21.14 | 3.40 | 0.36 | 0.11 | ○ | Δ |
| 20 | 8.19 | 21.14 | 7.60 | 0.93 | 0.13 | ○ | Δ |
| 20 | 6.97 | 21.14 | 7.60 | 1.09 | 0.15 | Δ | Δ |
| 20 | 5.80 | 21.14 | 7.60 | 1.31 | 0.18 | Δ | Δ |
| 20 | 4.70 | 21.14 | 7.60 | 1.62 | 0.22 | Δ | ○ |
| 20 | 6.38 | 21.14 | 7.60 | 1.19 | 0.17 | Δ | Δ |
| 20 | 7.09 | 21.85 | 7.60 | 1.07 | 0.15 | Δ | Δ |
| 20 | 7.73 | 22.50 | 7.60 | 0.98 | 0.15 | ○ | Δ |
| 20 | 8.90 | 21.85 | 3.80 | 0.43 | 0.12 | ○ | Δ |
| 20 | 8.19 | 21.14 | 7.60 | 0.93 | 0.13 | ○ | Δ |
| 20 | 8.19 | 21.14 | 8.36 | 1.02 | 0.13 | Δ | Δ |
| 20 | 6.38 | 22.97 | 5.70 | 0.89 | 0.18 | ○ | Δ |
| 20 | 6.38 | 24.85 | 5.70 | 0.89 | 0.19 | ○ | Δ |
| 20 | 6.38 | 26.80 | 5.70 | 0.89 | 0.21 | ○ | ○ |
| 15 | 9.48 | 21.14 | 3.40 | 0.36 | 0.15 | ○ | Δ |
| 15 | 8.19 | 21.14 | 7.60 | 0.93 | 0.17 | ○ | Δ |
| 15 | 6.97 | 21.14 | 7.60 | 1.09 | 0.20 | Δ | ○ |
| 15 | 5.80 | 21.14 | 7.60 | 1.31 | 0.24 | Δ | ○ |
| 15 | 4.70 | 21.14 | 7.60 | 1.62 | 0.30 | Δ | ○ |
| 15 | 6.38 | 21.14 | 7.60 | 1.19 | 0.22 | Δ | ○ |
| 15 | 7.09 | 21.85 | 7.60 | 1.07 | 0.21 | Δ | ○ |
| 15 | 7.73 | 22.50 | 7.60 | 0.98 | 0.19 | ○ | Δ |
| 15 | 8.90 | 21.85 | 3.80 | 0.43 | 0.16 | ○ | Δ |
| 15 | 8.19 | 21.14 | 7.60 | 0.93 | 0.17 | ○ | Δ |
| 15 | 8.19 | 21.14 | 8.36 | 1.02 | 0.17 | Δ | Δ |
| 15 | 6.38 | 22.97 | 5.70 | 0.89 | 0.24 | ○ | ○ |
| 15 | 6.38 | 24.85 | 5.70 | 0.89 | 0.26 | ○ | ○ |
| 15 | 6.38 | 26.80 | 5.70 | 0.89 | 0.28 | ○ | ○ |
| 10 | 9.48 | 21.14 | 3.40 | 0.36 | 0.22 | ○ | ○ |
| 10 | 8.19 | 21.14 | 7.60 | 0.93 | 0.26 | ○ | ○ |
| 10 | 6.97 | 21.14 | 7.60 | 1.09 | 0.30 | Δ | ○ |
| 10 | 5.80 | 21.14 | 7.60 | 1.31 | 0.36 | Δ | ○ |
| 10 | 4.70 | 21.14 | 7.60 | 1.62 | 0.45 | Δ | ○ |
| 10 | 6.38 | 21.14 | 7.60 | 1.19 | 0.33 | Δ | ○ |
| 10 | 7.09 | 21.85 | 7.60 | 1.07 | 0.31 | Δ | ○ |
| 10 | 7.73 | 22.50 | 7.60 | 0.98 | 0.29 | ○ | ○ |
| 10 | 8.90 | 21.85 | 3.80 | 0.43 | 0.25 | ○ | ○ |
| 10 | 8.19 | 21.14 | 7.60 | 0.93 | 0.26 | ○ | ○ |
| 10 | 8.19 | 21.14 | 8.36 | 1.02 | 0.26 | Δ | ○ |
| 10 | 6.38 | 22.97 | 5.70 | 0.89 | 0.36 | ○ | ○ |
| 10 | 6.38 | 24.85 | 5.70 | 0.89 | 0.39 | ○ | ○ |
| 10 | 6.38 | 26.80 | 5.70 | 0.89 | 0.42 | ○ | ○ |

As shown in TABLE 3, it was possible to effectively prevent the cracks in the front end part of the leg portion in the samples where D/A was set to 1.00 or lower. The reason for this is assumed that, although cracks occurred in the front end portion of the ceramic insulator due to collision of the front end portion of the center electrode with the ceramic insulator by the application of impact, the front end portion of the ceramic insulator was provided with sufficient strength against the volume (weight) of the front end portion of the center electrode by satisfaction of the relationship of $D/A \leq 1.00$.

It was also possible to prevent the cracks in the rear end part of the leg portion in the samples where (B/A)/L was set to 0.20 or higher. The reason for this is assumed that, although the stress exerted by impact on the rear end part of the leg portion was in proportion to the leg length L and the weight of the front end portion of the ceramic insulator, the rear end part of the leg portion was provided with sufficient strength against the stress by satisfaction of the relationship of (B/A)/L≥0.20.

It has been shown by the above test results that it is preferable to satisfy the relationships of D/A≤1.0 (mm) and (B/A)/L≥0.20 ($mm^{-1}$) for the purpose of preventing cracks in both of the front and rear end parts of the leg portion and significantly improving the breakage resistance of the ceramic insulator.

Spark plug samples in which, when the part of the ceramic insulator located front of the front end of the metal shell in the direction of the axis is projected onto the imaginary plane parallel to the axis, the area of the projected part (called "projected area") as varied by changing the protrusion length F (mm) of the front end of the ceramic insulator and the outer diameter of the front end portion of the ceramic insulator, 10 samples for each projected area, were prepared and each tested by knocking test.

The knocking test was herein performed by the following procedure. Each of the samples was mounted to a predetermined engine. The engine was operated in such a manner as to cause knocking. In the occurrence of knocking, an impact was applied to the front end portion of the ceramic insulator. The occurrence or non-occurrence of cracks in the ceramic insulator was checked. The number of the samples in which the cracks occurred in the ceramic insulator (called "crack sample number") was measured. The impact resistance was evaluated as very good and marked with "☆" when no cracks occurred in all of the 10 samples. When the crack sample number was 1 to 3, the impact resistance was evaluated as good and marked with "◎". The impact resistance was evaluated as satisfactory and marked with "○" when the crack sample number was 4 to 5. The impact resistance was evaluated as rather poor and marked with "Δ" when the crack sample number was 6 to 9. The test results of the knocking test are indicated in TABLE 4. The outer diameter of the front end portion of the ceramic insulator was decreased toward the front in samples 1 to 16, whereas the straight portion of constant outer diameter was formed on the front end portion of the ceramic insulator in samples 17 to 21. In samples 17 to 21, the distance X from the front end of the metal shell to the rear end of the straight region in the direction of the axis was set to various values assuming the front side in the direction of the axis with respect to the front end of the metal shell as the negative side (that is, the negative value of the distance X means the rear end of the straight portion was located rear of the front end of the metal shell in the direction of the axis).

TABLE 4

| No. | Protrusion length F (mm) | Front end outer diameter (mm) | Projected area ($mm^2$) | Presence of straight region | Distance X (mm) | Evaluation result |
|---|---|---|---|---|---|---|
| 1 | 1.0 | 4.0 | 4.0 | not present | — | ○ |
| 2 | 2.0 | 3.7 | 7.4 | not present | — | ○ |
| 3 | 2.0 | 4.0 | 8.0 | not present | — | ○ |
| 4 | 3.0 | 3.7 | 11.1 | not present | — | ○ |
| 5 | 3.0 | 4.0 | 12.0 | not present | — | ○ |
| 6 | 3.0 | 4.7 | 14.0 | not present | — | ○ |
| 7 | 4.0 | 3.5 | 14.0 | not present | — | ○ |
| 8 | 5.0 | 2.8 | 14.0 | not present | — | ○ |
| 9 | 6.0 | 2.3 | 14.0 | not present | — | ○ |
| 10 | 4.0 | 3.7 | 14.8 | not present | — | Δ |
| 12 | 4.0 | 4.0 | 16.0 | not present | — | Δ |
| 13 | 5.0 | 3.7 | 18.5 | not present | — | Δ |
| 14 | 5.0 | 4.0 | 20.0 | not present | — | Δ |
| 15 | 6.0 | 3.7 | 22.2 | not present | — | Δ |
| 16 | 6.0 | 4.0 | 24.0 | not present | — | Δ |
| 17 | 2.0 | 3.7 | 7.4 | present | 0 mm | ◎ |
| 18 | 2.0 | 3.7 | 7.4 | present | −0.5 mm | ☆ |
| 19 | 2.0 | 3.7 | 7.4 | present | −1 mm | ☆ |
| 20 | 2.0 | 3.7 | 7.4 | present | −2 mm | ☆ |
| 21 | 2.0 | 3.7 | 7.4 | present | −3 mm | ☆ |

As shown in TABLE 4, each of the samples where the projected area was 14.0 $mm^2$ or less had sufficient impact resistance. The reason for this is assumed that, although the part of the ceramic insulator protruding from the front end of the metal shell was subjected to impact by knocking, it was possible to reduce the impact exerted on the ceramic insulator and thereby possible to reduce the stress exerted on the rear end part of the leg portion by setting the projected area to a relatively small value.

Further, each of the samples where the straight region was formed on the front end portion of the ceramic insulator (i.e. samples 17 to 21) had better impact resistance. In particular, the impact resistance was very good in the samples where the rear end of the straight region was located rear of the front end of the metal shell in the direction of the axis.

It has been shown by the above test results that it is preferable to adapt the ceramic insulator and the like in such a manner that the projected area is 14.0 $mm^2$ or less for the purpose of further improving the breakage resistance of the ceramic insulator. It has also been shown that, for the purpose of further improving the breakage resistance of the ceramic insulator, it is preferable that the straight region is formed on the front end portion of the ceramic insulator and is particularly preferable that the rear end of the straight region is located rear of the front end of the metal shell.

The present invention is not limited to the above-mentioned embodiment and may be embodied as follows. It is needless to say that any application and modification examples other than those indicated below are possible.

(a) The curvature radius G of the curved surface portion 31 and the curvature radius H of the second curved surface portion 32 are constant in the above embodiment but are not necessarily constant. It is feasible to change the curvature radius G, H stepwisely or continuously. In this case, the curvature radius G (curvature radius H) means a curvature radius of an imaginary circle passing through three points: front and rear end points of the curved surface portion 31 (second curved surface portion 32) and a midpoint of the front and rear end points of the curved surface portion 31 (second curved surface portion 32) in the cross section through the axis CL1.

(b) Although the discharge gap 28 is defined between the center electrode 5 and the ground electrode 27 in the above embodiment, it is alternatively feasible to fix a noble metal tip of noble metal alloy (e.g. platinum alloy or iridium alloy) to at least one of the center electrode 5 and the ground electrode 27 and thereby define the discharge gap between the noble metal tip on one of the electrodes and the other of the electrodes or between the noble metal tips on the respective electrodes.

(c) In the above embodiment, the ground electrode 27 is joined to the front end portion 26 of the metal shell 3. It is alternatively feasible to form the ground electrode by cutting a part of the metal shell (or a part of a front end metal part previously joined to the metal shell) (see e.g. Japanese Laid-Open Patent Publication No. 2006-236906).

(d) Although the tool engagement portion 19 is hexagonal in cross section in the above embodiment, the shape of the tool engagement portion 19 is not limited to such a hexagonal cross-section shape. The tool engagement portion 19 may alternatively be formed into a Bi-HEX shape (modified dodecagonal shape) (according to ISO 22977: 2005(E)) or the like.

Having described the invention, the following is claimed:

1. A spark plug, comprising:

a cylindrical insulator extending in the direction of an axis of the spark plug;

an annular plate packing; and a cylindrical metal shell arranged circumferentially around the insulator, the insulator including a step portion formed on an outer circumferential surface thereof and having an outer diameter decreasing toward the front in the direction of the axis and a leg portion located front of the step portion and extending toward the front in the direction of the axis, the metal shell including a flat taper portion formed on an inner circumferential surface thereof and having an inner diameter decreasing toward the front in the direction of the axis, the insulator being fixed in the metal shell by crimping a rear end portion of the metal shell with the step portion of the insulator retained on the flat taper portion of the metal shell via the plate packing, the insulator further including a cylindrical middle body portion located rear of the step portion and extending in the direction of the axis, said middle body portion dimensioned to define a space that communicates with the plate packing between the cylindrical middle body portion of the insulator and the metal shell and the insulator still further including a curved surface portion formed in a concave shape on the outer circumferential surface thereof at a position between the step portion and the leg portion, said curved surface portion defining a middle region between front and rear ends thereof, 50% or more of an inner circumferential edge portion of the plate packing in a circumferential direction thereof being in contact with the insulator at a location in front of said middle region of the insulator.

2. The spark plug according to claim 1, wherein the entire circumference of the inner circumferential edge portion of the plate packing is in contact with the insulator at a location in front of the middle region of the insulator.

3. The spark plug according to claim 1, wherein the spark plug satisfies a relationship of $0.8 \leq G \leq 1.4$ where G (mm) is a curvature radius of the curved surface portion in a cross section through the axis.

4. The spark plug according to claim 3, wherein the insulator includes a second curved surface portion formed in a convex shape on the outer circumferential surface thereof at a position between the step portion and the cylindrical middle body portion; and wherein the spark plug satisfies a relationship of $1.0 \leq G/H \leq 3.0$ where, in a cross section through the axis, G (mm) is a curvature radius of the first-mentioned curved surface portion; and H (mm) is a curvature radius of the second curved surface portion.

5. The spark plug according to claim 1, wherein the spark plug satisfies a relationship of $\alpha \geq \beta$ where, in the cross section through the axis, $\alpha$(°) is an acute angle formed by an outline of the step portion and a straight line perpendicular to the axis; and $\beta$ (°) is an acute angle formed by an outline of the flat taper portion and a straight line perpendicular to the axis.

6. The spark plug according to claim 5, wherein the spark plug satisfies a relationship of $\alpha \leq \beta + 15$(°).

7. The spark plug according to claim 1, wherein the spark plug further comprises a center electrode inserted in the insulator and extending in the direction of the axis with a front end of the center electrode located front of a front end of the insulator in the direction of the axis; and wherein the spark plug satisfies relationships of $D/A \leq 1.00$ (mm) and $(B/A)/L \geq 0.20$ ($mm^{-1}$) where A ($mm^2$) is a cross-sectional area of the insulator, excluding the opening, taken at a front end of the metal shell in a direction perpendicular to the direction of the axis; B ($mm^2$) is a cross-sectional area of the insulator, excluding the opening, taken at a rear end of the leg portion in a direction perpendicular to the direction of the axis; L (mm) is a length from a boundary region between the cylindrical middle body portion and the step portion to a front end of the insulator in the direction of the axis; and D ($mm^3$) is a volume of a portion of the center electrode extending from a front end of the center electrode to a position of 1 mm rear from the front end of the insulator.

8. The spark plug according to claim 1, wherein, when a part of the insulator located front of a front end of the metal shell in the direction of the axis is projected onto an imaginary plane parallel to the axis, an area of the projected part is 14.0 $mm^2$ or less.

9. The spark plug according to claim 1, wherein the insulator includes, on a front end portion thereof, a straight region formed into a straight tubular shape of constant outer diameter and having a front end located front of a front end of the metal shell in the direction of the axis.

10. The spark plug according to claim 9, wherein the straight region has a rear end located rear of the front end of the metal shell in the direction of the axis.

11. The spark plug according to claim 1, wherein the insulator includes a second curved surface portion formed in a convex shape on the outer circumferential surface thereof at a position between the step portion and the cylindrical middle body portion; and wherein the plate packing extends to a position corresponding to the second curved surface.

* * * * *